US005409299A

United States Patent [19]

Holder

[11] Patent Number: 5,409,299

[45] Date of Patent: Apr. 25, 1995

[54] APPARATUS FOR REMOVING FLOOR COVERING

[75] Inventor: Tommie J. Holder, Snyder, Okla.

[73] Assignee: Cooper Floor Services, Inc., Rossevelt, Okla.

[21] Appl. No.: 147,178

[22] Filed: Nov. 3, 1993

[51] Int. Cl.[6] ..... B23D 79/02; B24B 7/18

[52] U.S. Cl. ..... 299/41; 451/353

[58] Field of Search ..... 299/41, 90; 51/174, 51/177; 125/5, 3; 15/93.1

[56] References Cited

U.S. PATENT DOCUMENTS

| | | | |
|---|---|---|---|
| 1,442,544 | 1/1923 | Schwenke | 30/170 |
| 2,864,104 | 12/1958 | Sage | 15/93.1 |
| 2,913,855 | 11/1959 | Vinella | 51/177 |
| 2,973,536 | 3/1961 | Doyle | 15/93.1 |
| 3,007,687 | 11/1961 | Hatcher | 299/39 |
| 3,098,329 | 7/1963 | Doran | 51/177 |
| 3,102,592 | 9/1963 | Vezner | 299/41 X |
| 3,347,596 | 10/1967 | Brejcha et al. | 299/10 |
| 4,099,328 | 7/1978 | Schlemmer | 30/172 |
| 4,172,615 | 10/1979 | Hakes | 299/30 |
| 4,251,896 | 2/1981 | Block | 15/49.1 |
| 4,486,931 | 12/1984 | Pichelman et al. | 29/81.05 |
| 4,523,361 | 6/1985 | Dummermuth | 51/176 X |
| 4,592,108 | 6/1986 | Svendsen | 15/4 |
| 4,614,380 | 9/1986 | Allen | 299/41 |
| 4,756,578 | 7/1988 | Mims et al. | 299/37 |
| 4,848,845 | 7/1989 | Kennedy | 299/39 |
| 5,081,734 | 1/1992 | Sanford et al. | 15/93.1 |
| 5,082,330 | 1/1992 | Holder | 299/37 |
| 5,184,429 | 2/1993 | Parsons | 299/41 X |
| 5,197,784 | 3/1993 | Holder | 299/37 |

FOREIGN PATENT DOCUMENTS

| | | |
|---|---|---|
| 189617 | 8/1986 | European Pat. Off. . |
| 284391 | 9/1988 | European Pat. Off. . |
| 2033214 | 8/1978 | United Kingdom . |

*Primary Examiner*—David J. Bagnell
*Attorney, Agent, or Firm*—Dunlap, Codding & Lee

[57] ABSTRACT

A rotary cutting attachment for removing linoleum, tile, mastic, grout, adhesive and the like from floors. The cutting attachment includes a drive plate, an elastomeric ring, a cutter head, a block plate, six cutter blocks and three cutter inserts per cutter block. The elastomeric ring separates the drive plate from the cutter head and allows the attachment to adjust to the contour of the floor. The drive plate and the cutter head have sets of gears which mesh to transfer rotation of the drive plate to the cutter head. In turn, an offset member of the cutter head mates with an offset bore of the block plate to transfer rotation of the cutter head to the block plate. The six cutter blocks are removably mounted to the block plate and three cutter inserts are removably mounted to each cutter block. Typically, three cutting attachments, each driven by a hydraulic motor, are utilized in concert to remove a floor covering. The three cutting attachments are arranged in a triangle such that the cutting path of one cutting attachment overlaps the cutting paths of the other two cutting attachment.

19 Claims, 5 Drawing Sheets

APPARATUS FOR REMOVING FLOOR COVERING

BACKGROUND OF THE INVENTION

1. Field of the Invention

The present invention relates generally to an apparatus for removing floor covering, and particularly, but not by way of limitation, to an apparatus using a rotary cutting attachment for removing linoleum, tile, grout, mastic, adhesive residue and the like from floors.

2. Description of Related Art

In removing floor coverings, the surface of the floor is often uneven. In some cases, the base surface of concrete or the like is not perfectly flat. In other situations, the base surface may be substantially flat, but residue of floor covering makes the upper surface irregular. Accordingly, the ability to adjust to the contour of the surface is important in removing floor covering efficiently.

Some devices for removing floor covering utilize a plurality of springs in order to adjust to the contour of the surface. For example, U.S. Pat. No. 4,614,380 discloses a scraper assembly which has two springs disposed between each blade holder and the scraper plate. As another example, U.S. Pat. No. 4,614,380 describes a stripping machine which includes three springs for each cutter pad of the machine.

The multiplicity of springs and components used in these devices may cause difficulties in operation and maintenance. First, more components generally means greater complexity of the device and increased chance of component failure. Second, the large number of springs and associated elements makes replacement of worn or damaged springs too difficult and time-consuming.

SUMMARY OF THE INVENTION

The present invention is a cutter attachment for removing floor covering from a surface. The cutter attachment includes a drive plate, a head plate, an elastomeric ring, a block plate, six cutter blocks and three cutter inserts mounted to each cutter block. The elastomeric ring separates the drive plate and the head plate and allows the cutter attachment to adjust to the contour of the surface.

The drive plate and the block plate are removably attached to the drive plate to rotate with the drive plate. The cutter blocks, in turn, are removably mounted to the block plate.

Three cutter attachments are typically utilized together to remove floor covering from a surface. A rotary motor is connected to each drive plate to rotate the cutter inserts against the floor covering.

A wheeled frame is provided for propelling the cutter attachments over the surface. The frame may be self-propelled or hand-propelled.

One object of the present invention is to provide an apparatus which adjusts to the contour of a surface for removing floor covering from the surface.

Another object of the present invention is to provide a cutting attachment which uses one elastomeric ring rather than multiple springs to the contour of the surface.

Yet another object of the present invention is to provide a cutting attachment for which single cutter inserts, multiple cutter inserts or all of the cutter inserts may be replaced quickly and easily.

Other objects, features and advantages of the present invention are apparent from the following detailed description when read in conjunction with the accompanying drawings and appended claims.

DETAILED DESCRIPTION OF THE PREFERRED EMBODIMENTS

Figure 1:
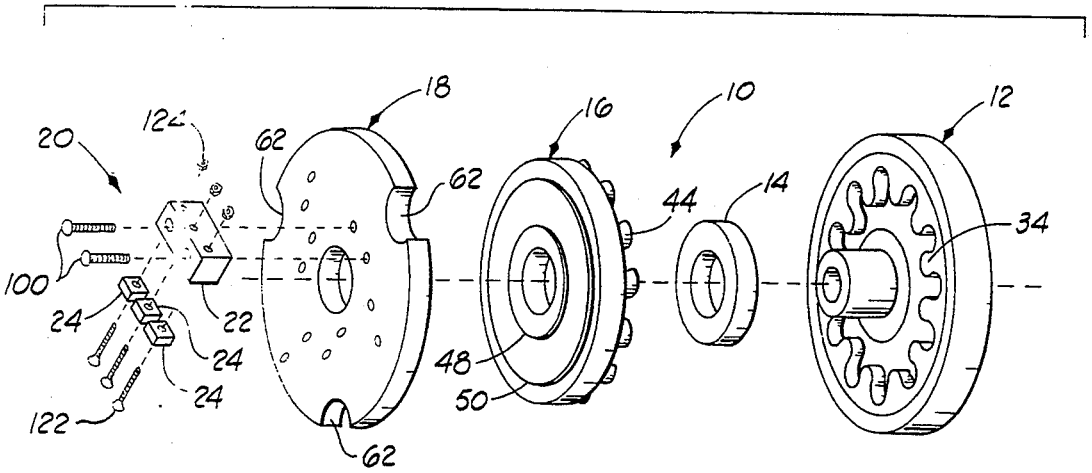
FIG. 1 is an exploded, perspective view of a cutter attachment constructed in accordance with the present invention. Only one cutter block and cutter insert are shown for clarity of illustration.

Referring to the drawings in general, and to FIG. 1 in particular, shown therein and designated by the general reference numeral 10 is a cutter attachment, which includes a drive plate 12, an elastomeric ring 14, a cutter head 16, a block plate 18, and a plurality of cutter assemblies 20.

Each cutter assembly 20 comprises a plurality of cutter blocks 22 and a plurality of cutter inserts 24. Only one cutter assembly 20 is shown in FIG. 1 for clarity of illustration.

Figure 2:
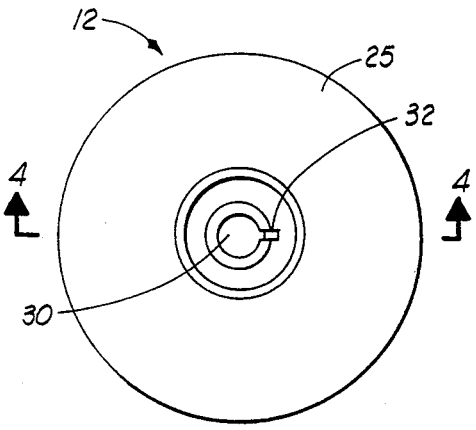
FIG. 2 is a top plan view of the drive plate of the cutter attachment shown in FIG. 1.
Figure 3:
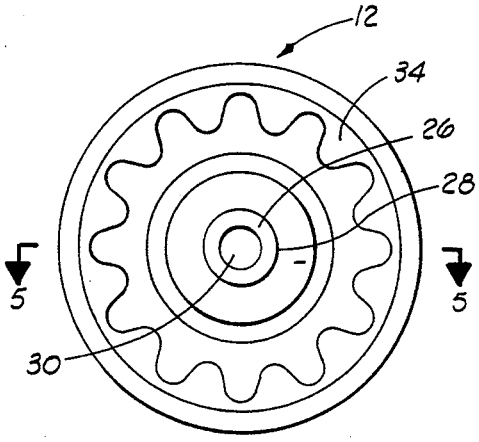
FIG. 3 is a bottom plan view of the drive plate of FIG. 2.
Figure 4:
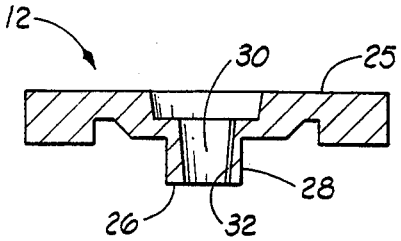
FIG. 4 is sectional view taken along the lines 4—4 of FIG. 3.
Figure 5:
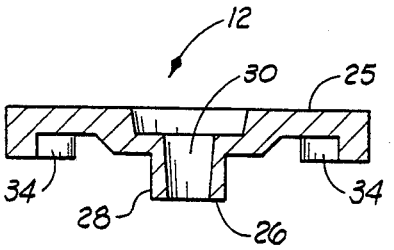
FIG. 5 is a sectional view taken along the lines 5—5 of FIG. 3.

As shown in FIGS. 1 through 5, the drive plate 12 is basically a circular plate having an upper end 25 and a lower end 26. A drive sleeve 28 protrudes from the lower end 26 of the drive plate 12. As best seen in FIGS. 2 and 4, a drive bore 30 having a keyway 32 extends through the drive sleeve 28 and reduces in diameter from the upper end 25 to the lower end 26. The drive bore 30 and keyway 32 are adapted to receive the keyed drive shaft of a motor.

As best illustrated by FIGS. 1 and 3, a plurality of recessed gear teeth are formed in the lower end 26 of the drive plate 12. One of the recessed gear teeth is designated by reference numeral 34 and is generally representative of the recessed gear teeth of the drive plate 12.

The elastomeric ring 14 is sized to be disposed around the drive sleeve 28 of the drive plate 12. The elastomeric ring 14 acts as a spacer between the drive plate 12 and the cutter head 16. In addition, the elastomeric ring 14 deforms to adjust the positions of the cutter inserts 24 to the contour of the floor covering being removed.

Referring now to FIGS. 6 through 9, shown therein is the cutter head 16 separately. The cutter head 16 is generally cylindrical in shape and has a center bore 36 which is sized to receive the drive sleeve 28 of the drive plate 12. A frustoconical ring recess 38 is formed in the upper end 40 of the cutter head 16. At the bottom of the ring recess 38 is a ring base 42 which circumscribes the center bore 36 and is sized to engage one end of the elastomeric ring 14.

Typically, the diameter of the center bore 36 is not uniform in diameter for its length. The center bore 36 is wider at its upper end and its lower end.

Figure 6:
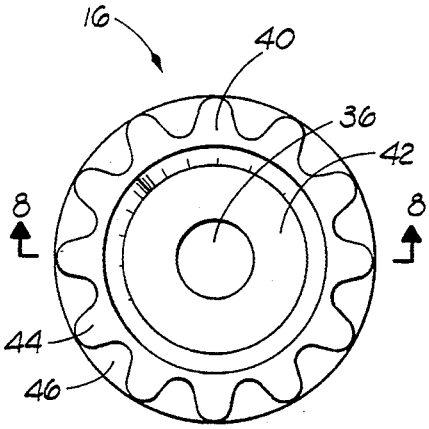
FIG. 6 is a top plan view of the cutter plate of the cutter attachment shown in FIG. 1.

As best seen in FIG. 6, a plurality of gear teeth, arranged in a circular pattern, are provided at the upper end 40 of the cutter head 16. One of the gear teeth is designated by reference numeral 44 and is generally representative of the cutter head gear teeth.

Between each adjacent pair of gear teeth 44 is a gear space, which is sized and shaped to receive one of the drive plate gear teeth 34. One of the cutter head gear spaces is designated by reference numeral 46 and is generally representative of the gear spaces of the cutter head 16. It should be appreciated that the gear teeth 34 of the drive plate 12 and the gear teeth 44 of the cutter head 16 are sized and shaped to intermesh when the drive plate 12 and the cutter head 16 are assembled together.

Figure 7:
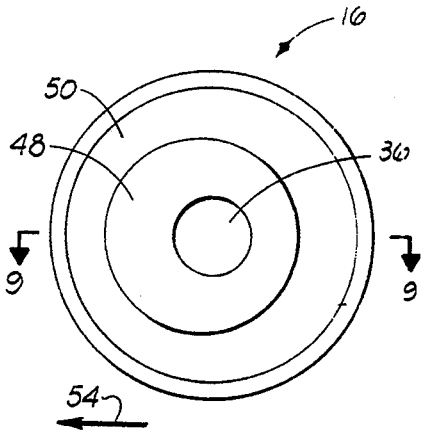
FIG. 7 is a bottom plan view of the cutter plate of FIG. 6.
Figure 8:
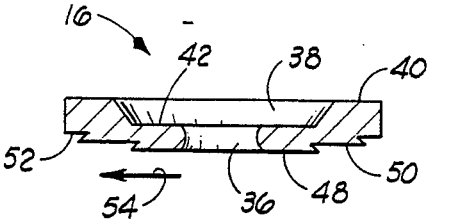
FIG. 8 is a sectional view taken along the lines 8—8 of FIG. 7.
Figure 9:
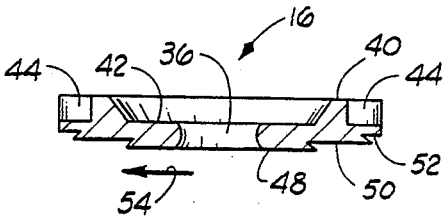
FIG. 9 is a sectional view taken along the lines 9—9 of FIG. 7.

As illustrated by FIGS. 7 through 9, a pair of frustoconical members 48 and 50 protrude from the bottom 52 of the cutter head 16. The outer member 50 is centered with the center bore 36 of the cutter head 16. The inner member 48, however, is offset from the center bore 36 as indicated by direction arrow 54.

It should be appreciated that the amount of offset from center of the inner member 48 is exaggerated in FIGS. 7 through 9 for clarity of illustration. In actuality, the displacement of the inner frustoconical member 48 of the cutter head 16 is in the range of 0.2 inches from center.

Figure 10:
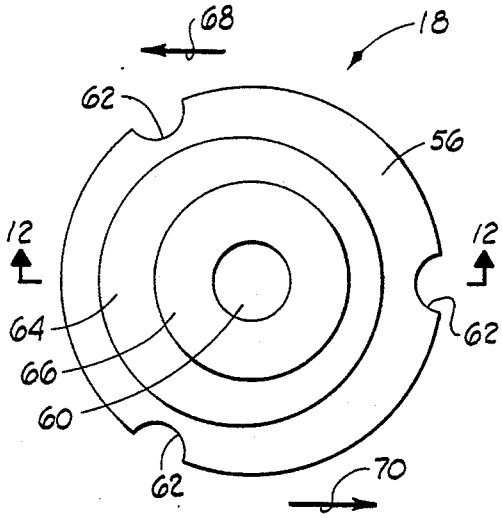
FIG. 10 is a top plan view of the block plate of the cutter attachment of FIG. 1.
Figure 11:
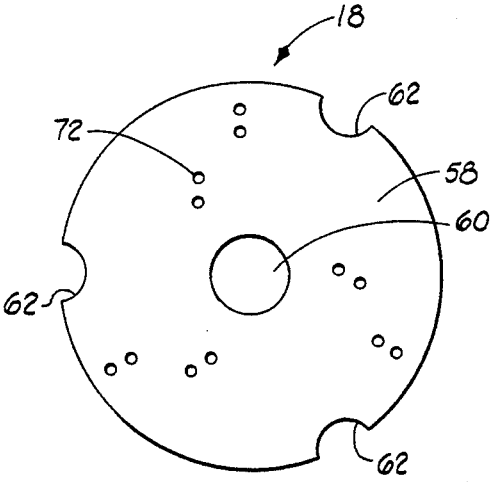
FIG. 11 is a bottom plan view of the block plate of FIG. 10.
Figure 12:
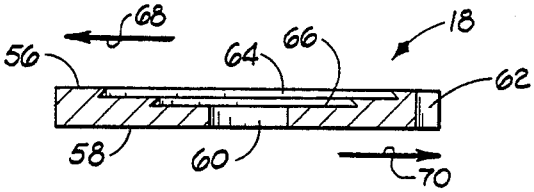
FIG. 12 is a sectional view taken along the lines 12—12 of FIG. 11.

With reference to FIGS. 10 through 12, shown therein is one of the block plates 18 separately. Each block plate 18 is basically a circular plate with an upper end 56 and a lower end 58. A center bore 60 extends through the block plate 18 from the upper end 56 to the lower end 58. A plurality of spaced apart hammer notches 62 extend inward from the circumference of the block plate 18.

As best seen in FIGS. 10 and 12, a pair of frustoconical recesses 64 and 66 are provided in the upper end 56 of the block plate 18. The upper recess 64 is greater in diameter than the lower recess 66. Moreover, the upper recess 64 is offset from the center of the block plate 18 in one direction (as indicated by direction arrow 68), whereas the lower recess 66 is offset from center in the opposite direction (as indicated by direction arrow 70).

It should be appreciated that the upper end diameter of the upper recess 64 is just slightly greater than the lower end diameter of the outer member 50. Similarly, the upper end diameter of the lower recess 66 is slightly greater than the lower end diameter of the inner member 48.

With this construction, the inner member 48 and the outer member 50 are insertable into the lower recess 66 and upper recess 64, respectively, when the offset of the inner member 48 is aligned with the offset of the lower recess 66. When the block plate 18 is rotated after the insertion, however, the inner member 48 and outer member 50 become wedge-locked in the lower recess 66 and upper recess 64, respectively. The wedge-locking is effected by the offsets from center of the inner member 48, the lower recess 66 and the upper recess 64.

In this manner, the block plate 18 may be removably secured to the cutter head 16. It should be appreciated that the block plate 18 may be rotated either clockwise or counter-clockwise to secure the block plate 18 to the cutter head 16. A hammer or the like may be used to strike one of hammer notches 62 to wedge-lock the block plate 18 to the cutter head 16. Of course, the block plate 18 is normally rotated and wedge-locked in the direction in which the block plate 18 is to be rotated during operation.

The block plate 18 is easily removed by striking one of the hammer notches 62 in the direction opposing the operational rotation of the block plate 18 to break the wedge-lock. Then the block plate 18 is rotated so that the inner member 48 is concentric with the lower recess 66 and the outer member 50 is concentric with the upper recess 64. When this double concentricity occurs, the inner and outer members 48 and 50 of the cutter head 16 are positioned to exit the recesses 64 and 66 of the block plate 18 and the block plate 18 may be separated from the cutter head 16.

Figure 13:
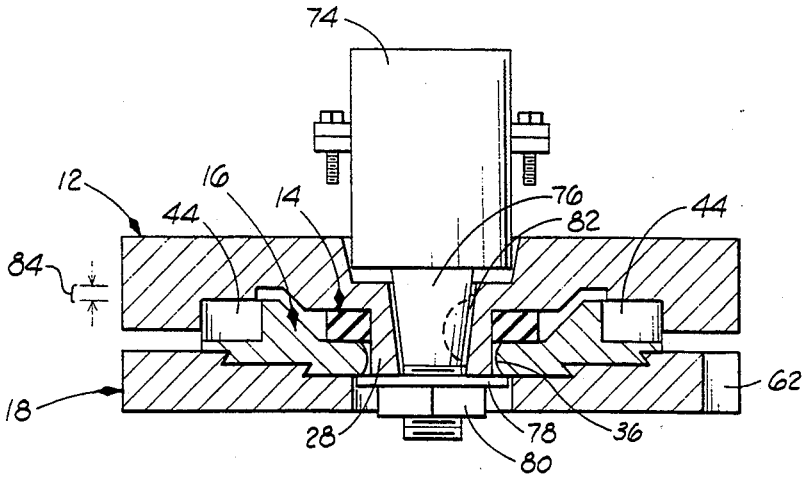
FIG. 13 is a partly sectional, partly diagrammatical side view of the assembly of the drive plate, elastomeric ring, cutter head and block plate with a motor.

The wedge-locking relationship of the cutter head 16 and block plate 18 is best illustrated by FIG. 13. The inner member 48 of the cutter head 16 is in tight engagement with the walls forming the lower recess 66 of the block plate 18. Similarly, the outer member 50 of the cutter head 16 is in a wedged position within the upper recess 64 of the block plate 18.

As shown in FIG. 11, a plurality of threaded holes extend into the lower end 58 of the block plate 18. One of the threaded holes of the block plate 18 is designated by reference numeral 72 and is generally representative of the threaded holes in the bottom 58 of the block plate 18. It should be appreciated that the threaded holes 72 are arranged in a particular pattern for the mounting of the cutter blocks 22 to the block plate 18.

Turning now to FIG. 13, shown therein is the assembly of the drive plate 12, the elastomeric ring 14, the cutter head 16 and the block plate 18 with a motor 74. The motor 74 has a rotatable shaft 76 with a threaded end. The shaft 76 is journaled through the drive sleeve 28 of the drive plate 12 and the center bore 60 of the block plate 18.

A washer 78 is disposed around the shaft 76 just below the cutter head 16 and a lock nut 80 is threaded onto the threaded end of the shaft 76 to secure the drive shaft 76 in the drive sleeve 28 of the drive plate 12.

The shaft 76 of the motor 74 is adapted for a key 82 to protrude radially from the shaft 76. The key 82 is inserted into the keyway 32 of the drive plate 12 in order for the drive plate 12 to rotate in response to the rotation of the motor shaft 76.

The motor 74 is typically a hydraulic motor. It should be appreciated, however, that an electric motor, a pneumatic motor or any other conventional motor may be utilized with the cutter attachment 10.

As illustrated by FIG. 13, the elastomeric ring 14 is disposed around the drive sleeve 28 of the drive plate 12 and fits between the ring base 42 of the cutter head 16 and the drive plate 12. The thickness of the elastomeric ring 14 should be sufficient to space the drive plate 12 a distance from the cutter head 16. This distance of separation is indicated by reference numeral 84 and is typically in the range of 150 to 250 thousandths of an inch.

The separation between the drive plate 12 and cutter head 16 allows the cutter head 16 and the attached block plate 18 to tilt with respect to the drive plate 12. If the floor covering being removed is not perfectly level, the elastomeric ring 14 deforms to match the block plate 18 with the contour of the floor covering beneath the block plate 18.

In addition, the wider upper and lower portions of the center bore 36 allow some movement of the cutter head 16 around the drive sleeve 28. This construction also is important in order for the block plate 18 and cutter assemblies 20 to adjust to any unevenness in the floor.

The gear teeth 34 of the drive plate 12 are meshed with the gear teeth 44 of the cutter head 16 to transfer the rotation of the drive plate 12 to the cutter head 16. In turn, the inner and outer members 48 and 50 of the cutter head 16 are wedge-locked within the upper and lower recesses 64 and 66 of the block plate 18 to transfer rotation of the cutter head 16 to the block plate 18.

The cooperation of the gear teeth 34 and 44 provide a better cutting drive than that of a central shaft. With a cutting attachment drive solely from a central shaft, rotational torque tends to lift one side from the floor when the opposite side binds into the floor covering.

The gear teeth 34 and 44 are positioned toward the outer diameter of the drive plate 12 and cutter head 16. Accordingly, the rotational drive provided by the gear teeth 34 and 44 is centered directly over the cutter assemblies 20. This arrangement helps prevent one side of the cutter attachment 10 from lifting when a cutter assembly 20 on the opposite side hangs in the floor covering being removed.

Figure 14:
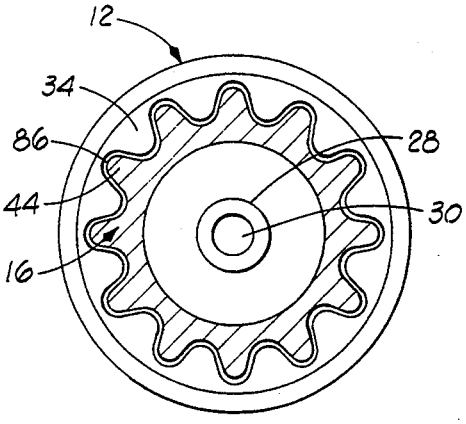
FIG. 14 is a bottom plan view of the drive plate assembled with the cutter head. The cutter head is sectioned to illustrate the cooperation of the drive plate gears with the cutter head gears to transfer rotation of the drive plate to the cutter head.

With reference to FIG. 14, shown therein is the assembly of the drive plate 12 and cutter head 16. It should be appreciated that the cutter head 16 is sectioned to illustrate the meshing of the gear teeth 44 of the cutter head 16 with the gear teeth 44 of the drive plate 12.

The gear teeth 34 of the drive plate 12 and the gear teeth 44 of the cutter head 16 are both rounded to define an undulant, intermeshing arrangement. In addition, it should be appreciated that the gear teeth 34 and 44 are loosely intermeshed with a uniform spacing, indicated by reference numeral 86, between the gear teeth 34 and 44.

The loose intermeshing of the rounded teeth 34 and 44 allows a limited degree of cutter head 16 movement which is independent from the drive plate 12. This limited range of movement enables the cutter head 16 to tilt with respect to the drive plate 12 for adjustment of the block plate 18 and cutter inserts 24 to the contour of the floor covering being removed.

Figure 15:
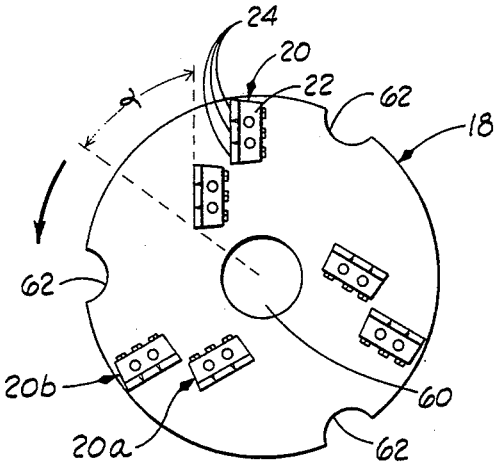
FIG. 15 is a bottom plan view of the block plate with six cutter blocks attached and three cutter inserts mounted to each cutter block.

Referring now to FIG. 15, shown therein are the cutter blocks 22 and cutter inserts 24 mounted to the bottom 58 of the block plate 18. This arrangement is utilized for rotation of the block plate 18 in the counterclockwise direction, as indicated by rotation arrow 88.

The cutter blocks 22 are arranged in two groups of three. Three inner cutter blocks, designated by reference character **20*a*, are mounted to an inner area of the bottom 58 of the block plate 18. The inner cutter blocks 22*a* are substantially equidistant from one another and from the center bore 60 of the block plate 18**.

In similar fashion, three outer cutter blocks **20*b* are mounted to an outer area of the bottom 58 of the block plate 18. Like the inner cutter blocks 20*a*, the outer cutter blocks 20*b* are typically equidistant from one another and the center bore 60 of the block plate 18**.

As indicated by the reference character $\alpha$, the inner cutter blocks **20*a* and the outer cutter blocks 20*b*** are offset from radial alignment. Typically, the offset from radial alignment $\alpha$ is between 30 and 45 degrees.

The offset provided by angle $\alpha$ helps protect the leading edge of the cutter inserts 24 from excessive wear. By being offset from the radial alignment, the cutter inserts 24 strike the floor covering obliquely. This oblique cutting action allows the cutter inserts 24 to remain sharp longer than a more direct cutting action.

Furthermore, each inner cutter block **20*a* is paired with one of the outer cutter blocks 20*b*. It should be appreciated that the dimensions and positions of the cutter blocks 20*a* and 20*b* and cutter inserts 24 are such that the cutting path of each outer cutter block 20*b* overlaps and trails the cutting path of the corresponding inner cutter block 20*a***.

Figure 16:
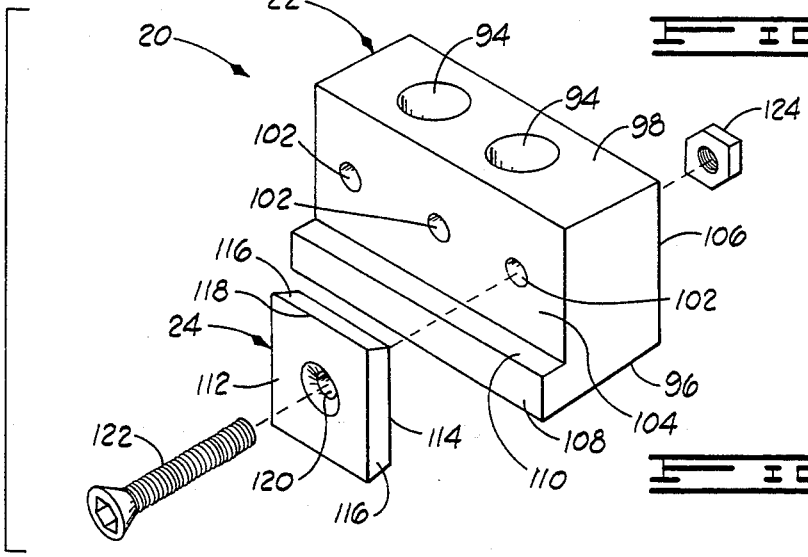
FIG. 16 is an exploded perspective view of a cutter block and a cutter insert. Only one cutter insert is shown for clarity of illustration.

With reference now to FIG. 16, shown therein is one of the cutter assemblies 20, which typically includes three cutter inserts 24 mounted to one cutter block 22. For clarity of illustration, only one of the three cutter inserts 24 is shown in FIG. 16.

It should be appreciated that the number of cutter inserts 24 and the dimensions of the cutter inserts 24 may be varied. For example, one elongated cutter insert 24 mounted to each cutter block 22 may cut some floor coverings better than three cutter inserts 24. The number and dimensions of the cutter inserts 24 may be easily changed to adapt the cutter attachment 10 to the particular floor covering being removed.

Each cutter block 22 has a pair of mounting holes 94 extending from the base 96 to the opposite end 98 of the cutter block 22. Each mounting hole 94 is adapted to receive a threaded fastener 100 (as shown in FIG. 1) in a countersunk fashion. The threaded fastener 100 is screwed into a corresponding one of the threaded holes 72 in the bottom 58 of the block plate 18 to secure the cutter block 22 to the block plate 18.

Furthermore, each cutter block 22 has three mounting holes 102 which extend from the front 104 to the rear 106 of the cutter block 22 for mounting the cutter inserts 24 to the cutter block 22. Each cutter block 22 includes a front base extension 108 which has an aligning surface 110 adjoining the front face 104 of the cutter block 22.

Each cutter insert 24 is basically a pyramidic frustum in shape with a front 112, a rear 114 and four beveled sides 116. The edges between each side 116 and the front 112 define four cutting edges, such as the cutting edge 118. A mounting hole 120 extends through each cutter insert 24 from the front 112 to the rear 114 of the cutter insert 24. Each mounting hole 120 is typically adapted to receive a bolt 122 in a countersunk manner.

Each cutter insert 24 is mounted to one of the cutter blocks 22 by inserting the bolt 122 through one of the mounting holes 120 of the cutter insert 24 and through one of the mounting holes 102 of the cutter block 22 and then tightening a nut 124 to the bolt 122 at the rear 106 of the cutter block 22. The front face 104 of the cutter block 22 engages the rear 114 of the cutter insert 24 and the aligning surface 110 of the cutter block 22 engages the side 116 of the cutter insert 24 opposing the cutting edge 118 to hold the cutter insert 24 in the cutting position.

As mentioned previously, the floor covering to be removed may include one or more of a wide variety of materials. Such materials may have very different physical characteristics. For example, floor adhesives are typically soft and sticky while dry grout and ceramic tile are relatively hard and brittle.

In removing a tacky material, cutting and lifting is found to be effective. Cutting and scraping is more efficient, however, for removal of dry material. Accordingly, it is desirable to be able to change the angle of the cutting edge to the floor covering, depending on the composition of the floor covering.

Figure 17:
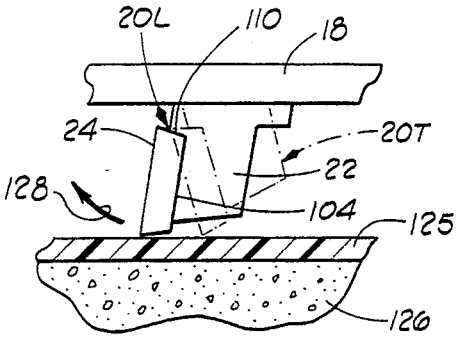
FIG. 17 is a partly sectional, partly diagrammatical side view of a cutter insert in position to remove a floor covering.
Figure 18:
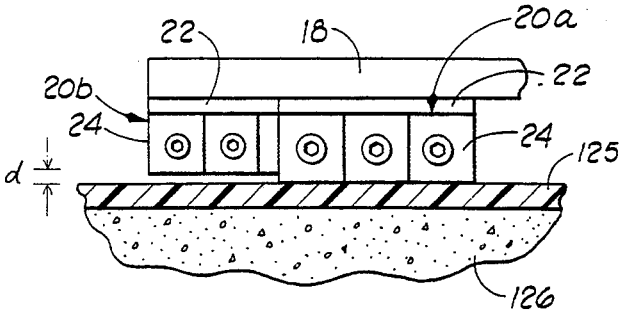
FIG. 18 is a partly sectional, partly diagrammatical front view of an outer cutter block and an inner cutter block in position to remove a floor covering.

With reference to FIG. 17, shown therein are variations in the construction of cutting blocks 22 for changing the cutting angle of the cutter inserts 24. It should be appreciated that the cutter inserts 24 actually cut into a floor covering 125 all the way to the concrete subsurface 126. For clarity of illustration, the cutter inserts 24 in FIGS. 17 and 18 are shown at the upper surface of the floor covering 125.

In the case of a lifting cutter assembly 20L (shown in solid lines), the front face 104 and the aligning face 110 are located to position the cutter inserts 24 ahead of perpendicularity with a floor covering 125 laid on a concrete subsurface 126. As indicated by direction arrow 128, the cutter insert 24 lifts as it cuts.

For the lifting cutter assemblies 20L, cutter blocks 22 may be provided to dispose the cutter inserts 24 at angles between zero and ten degrees ahead of perpendicularity with floor covering 125. The greater the leading angle of the cutter inserts 24, the more lifting action is provided. Thus the cutter assembly 20L would typically be utilized in removing a tacky or sticky floor covering 125.

In contrast, the cutter assembly 20T (shown in phantom lines in FIG. 17) includes a cutter block 22 which positions the cutter insert 24 at an angle behind perpendicularity with the floor covering 125. This trailing angle may be at angle from the perpendicular to about ten degrees behind perpendicular. The cutter assembly 20T provides more of a scraping action than a lifting action and would be suited for removing non-sticky floor coverings 125.

As the cutting attachment 10 is moved over the floor, the cutter inserts 24 of the outer cutter assemblies **20*b* tend to encounter more uncut floor covering 125 than the cutter inserts 24 of the inner cuttering assemblies 20*a*. Thus if the cutter inserts 24 of the outer cutter assemblies 20*b* are even with the cutter inserts 24 of the inner cutter inserts 20*a*, the outer cutter inserts 24 tend to wear and become dull faster than the inner cutter inserts 24**.

Referring to FIG. 18, shown therein is an arrangement for making the wear on the cutter inserts 24 of the inside and outside cutter assemblies **20*a* and 20*b* more balanced. In this arrangement, the cutter blocks 22 of the inner and outer cutter assemblies 20*a* and 20*b* are sized and shaped to position their respective cutter inserts 24 at different distances from the block plate 18. The cutter inserts 24 of the outer cutter assemblies 20*b* are located a distance d closer to the block plate 18 than the cutter inserts 24 of the inner cutter assemblies 20*a***. The distance d is typically in the range of 50 thousandths of an inch.

With this construction, a majority of the weight of the cutter attachment 10 is supported on the cutter inserts 24 of the inner cutter assemblies **20*a*. This weight distribution and the slightly elevated posture of the outer cutter assemblies 20*b* makes the cutter attachment 10 less likely to get into a bind caused by the outer cutter assemblies 20*b* becoming buried too deep in the floor covering 125**.

It should be appreciated that the construction and arrangement of components described hereinabove provide a great deal of versatility in the maintenance and operation of the cutting attachment 10. For example, each cutter insert 24 has four cutting edges 118. When one cutting edge 118 becomes dull or damaged, the cutter insert 24 may be loosened from its cutter block 22, turned to dispose a different cutting edge 118 to the floor covering 125, and then secured again to its cutter block 22.

Furthermore, individual cutter assemblies 20 may be replaced, either to change the amount of lifting action or to have sharper cutting edges 118. In matching the amount of lifting or scraping in the cutting action, cutter blocks 22 which dispose the cutter inserts 24 at different angles to the floor covering may be die-stamped or color-coded for ease of identification.

In addition, the entire block plate 18, with its cutter assemblies 20, may be changed out. The steps in removing and attaching the block plate 18 to the cutter head 16 have been described hereinabove. Several block plates 18, each having cutter assemblies 20L and 20T for different cutting actions, may be kept on hand. In this way, one block plate 18 may be easily and quickly switched out to achieve a different lifting or scraping action.

It should also be appreciated that the construction described herein allows the use of uniformly sized and shaped cutter inserts 24. Whether the lifting cut of cutter assembly 20L or the scraping cut of cutter assembly 20T is desired, the same cutter inserts 24 may be utilized.

Figure 19:
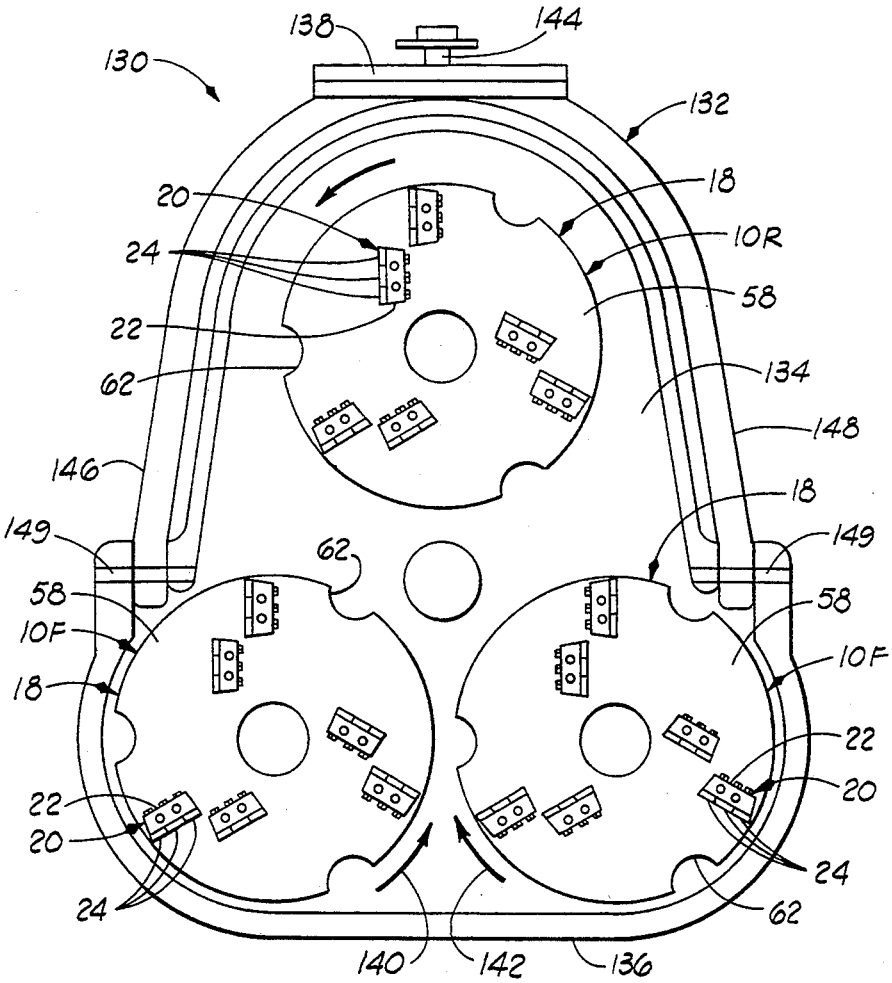
FIG. 19 is a bottom plan view of three cutter attachments constructed and mounted to a frame in accordance with the present invention for removing a floor covering.

With reference now to FIG. 19, shown therein and designated by reference numeral 130 is an apparatus for removing floor covering, which includes a frame 132 and three of the cutting attachments 10. The frame 132 has a bottom 134, a front end 136 and a rear end 138.

The three cutting attachments 10 protrude from bottom 134 of the frame 132 with two of the cutting attachments 10F toward the front 136 of the frame 132 and one cutting attachment 10R toward the rear 138 of the frame 132. The rear cutting attachment 10R is located so that its cutting path partially overlaps the cutting paths of both front cutting attachments 10F.

As indicated by rotation arrows 140 and 142, the front cutting attachments 10F are adapted to rotate in opposing directions. Although shown to rotate counterclockwise in FIG. 19, the rear cutter attachment 10R may be set up to rotate in either direction.

The frame 132 includes a rear rod connector 144 for pivotal attachment of the frame 132 to a hand-pushed or riding vehicle to facilitate moving the frame 132 and the three cutting attachments 10F and 10R over a floor. By pivotally attaching the frame 132 to a vehicle with the rod connector 144, the frame 132 is free to tilt from side 146 to side 148 and adjust to the contour of the floor covering being removed.

Furthermore, the frame 132 is mounted with pivot pins 149 on each side. This mounting allows the frame 132 to pivot with respect to the front end 136 and the rear end 138 of the frame 132 to adjust to an uneven floor.

Figure 20:
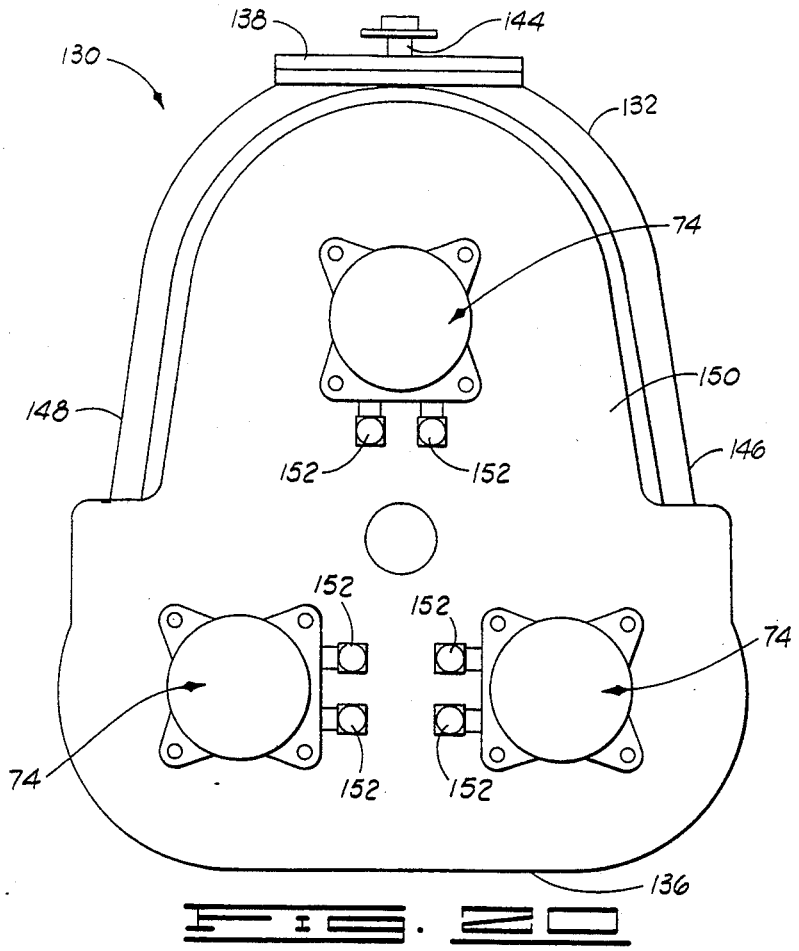
FIG. 20 is a top plan view of the frame of FIG. 19 with three motors for rotating the three cutter attachments shown in FIG. 19.

As illustrated by FIG. 20, three hydraulic motors 74 are mounted to the top 150 of the frame 132. It should be appreciated that the rotatable drive shaft 76 of each motor 74 extends through an opening through the frame 132 and is connected to a corresponding one of the cutter attachments 10F or 10R.

Each motor 74 has hydraulic connectors 152 for attaching the motor 74 through hydraulic lines to a conventional hydraulic system to power the rotation of the drive shaft 76 of the motor 74. The hydraulic system is typically carried by the vehicle to which the frame 132 is attached.

Hydraulic motors 74 are typically utilized to drive the rotation of the cutter attachments 10F and 10R. It should be appreciated that motors powered by electricity, air or gas pressure or any other power source known in the art may be used.

Figure 21:
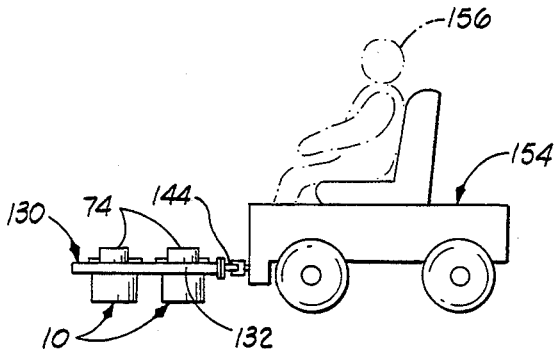
FIG. 21 is a diagram of the frame and cutter attachments of FIGS. 19 and 20 mounted to a vehicle which is driven by an operator.

As illustrated by FIG. 21, the frame 132 may be connected to a self-propelled vehicle 154 which is ridden by an operator 156. This mode of operation is best suited for removing floor covering from large, open areas.

Figure 22:
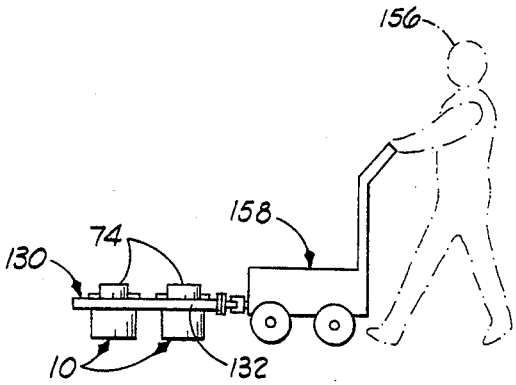
FIG. 22 is a diagram of the frame and cutter attachments of FIGS. 19 and 20 mounted to a vehicle which is pushed by an operator.

As shown in FIG. 22, the frame 132 may also attached to a vehicle 158 which is pushed by the operator 156. This arrangement is useful for removing floor covering from small or close areas.

Changes may be made in the combinations, operations and arrangements of the various parts and elements described herein without departing from the spirit and scope of the invention as defined in the following claims.

What is claimed is:

1. A cutter attachment for removing floor covering, the cutter attachment comprising:

a rotatable drive plate having an upper end, a lower end, a drive sleeve extending from the lower end thereof, and a plurality of drive gears located at the lower end thereof;

a cutter head having an upper end, a lower end, a bore receiving the drive sleeve of said drive plate, and a plurality of driven gears located at the upper end thereof and meshing with the drive gears of said drive plate;

an elastomeric ring disposed around the drive sleeve and spacing apart said drive plate and said cutter head;

a block plate having an upper end and a lower end, the upper end being removably secured to the lower end of said cutter head; and a plurality of cutter assemblies removably mounted to the lower end of said block plate, said cutter assemblies being adapted to remove floor covering when said drive plate is rotated.

2. The cutter attachment of claim 1 wherein each one of said cutter assemblies further comprises:

a cutter block removably secured to the lower end of said block plate; and a plurality of cutter inserts removably secured to said cutter block, each cutter insert having a cutting edge for removing floor covering.

3. The cutter attachment of claim 2 wherein said cutter block supports said cutter inserts at an angle between 75 and 115 degrees with the lower end of said block plate.

4. The cutter attachment of claim 2 wherein said cutter assemblies further comprise:

three inner cutter assemblies arranged in a space, substantially equidistant relationship in a central area of the lower end of said block plate; and three outer cutter assemblies arranged in a spaced, substantially equidistant relationship with one another in a perimeter area of the lower end of said block plate.

5. The cutter attachment of claim 4 wherein each one of said inner cutter assemblies extends farther from the lower end of said block plate than said outer cutter assemblies.

6. An apparatus for removing a floor covering from a surface, the apparatus comprising:

a frame having a front end and a rear end;

a motor mounted to said frame and having a rotatable drive shaft disposed toward the surface;

a rotatable drive plate operatively connected to the drive shaft of said motor and having an upper end, a lower end, a drive sleeve extending from the lower end thereof, and a plurality of drive gears located at the lower end thereof;

a cutter head having an upper end, a lower end, a bore receiving the drive sleeve of said drive plate, and a plurality of driven gears located at the upper end thereof and meshing with the drive gears of said drive plate;

an elastomeric ring disposed around the drive sleeve of said drive plate;

a block plate having an upper end and a lower end, the upper end of said block plate being removably secured to the lower end of said cutter head; and a plurality of cutter assemblies removably mounted to the lower end of said block plate, said cutter assemblies being adapted to remove floor covering when said drive plate is rotated by said motor;

wherein said elastomeric ring is sized and shaped to space apart said drive plate from said cutter head and to allow the cutter assemblies to conform to the contour of the surface.

7. The apparatus of claim 6 further comprising: means for propelling said frame over the surface.

8. The cutter attachment of claim 7 wherein said cutter block supports said cutter inserts at an angle between 75 and 115 degrees with the lower end of said block plate.

9. The cutter attachment of claim 7 wherein said cutter assemblies further comprise:

three inner cutter assemblies arranged in a space, substantially equidistant relationship in a central area of the lower end of said block plate; and three outer cutter assemblies arranged in a spaced, substantially equidistant relationship with one another in a perimeter area of the lower end of said block plate.

10. The cutter attachment of claim 9 wherein each one of said inner cutter assemblies extends farther from the lower end of said block plate than said outer cutter assemblies.

11. The apparatus of claim 6 wherein said motor are hydraulic.

12. The apparatus of claim 6 wherein said motor are electric.

13. The cutter attachment of claim 6 wherein each one of said cutter assemblies further comprises:

a cutter block removably secured to the lower end of said block plate; and a plurality of cutter inserts removably secured to said cutter block, each cutter insert having a cutting edge for removing floor covering.

14. An apparatus for removing a floor covering from a surface, the apparatus comprising:

a frame having a front end and a rear end;

three motors mounted to said frame in spaced relationship as two front motors and a center rear motor, each one of said motors having a rotatable drive shaft;

three rotatable drive plates, each one of said drive plates being operatively connected to a corresponding one of said motors and having an upper end, a lower end, a drive sleeve extending from the lower end thereof, and a plurality of drive gears located at the lower end thereof;

three cutter heads, each one of said cutter heads having an upper end, a lower end, a bore receiving the drive sleeve of a corresponding one of said drive plates, and a plurality of driven gears located at the upper end thereof and meshing with the drive gears of said corresponding drive plate;

three elastomeric rings, each one of said elastomeric rings being disposed around the drive sleeve of a corresponding one of said drive plates;

three block plates, each one of said block plates having an upper end and a lower end, the upper end of each block plate being removably secured to the lower end of a corresponding one of said cutter heads; and a plurality of cutter assemblies removably mounted to the lower end of each one of said block plates, said cutter assemblies being adapted to remove floor covering when the corresponding one of said drive plates is rotated;

wherein each one of said elastomeric rings is sized and shaped to space apart the corresponding drive plate and cutter head to allow the cutter assemblies to conform to the contour of the surface.

15. The apparatus of claim 14 further comprising: means for propelling said frame over the surface.

16. The apparatus of claim 14 wherein said motors are hydraulic.

17. The apparatus of claim 14 wherein said motors are electric.

18. The apparatus of claim 14 wherein said motors are pneumatic.

19. The apparatus of claim 14 wherein the drive shafts of said front motors are adapted to rotate in opposite directions.

* * * * *

UNITED STATES PATENT AND TRADEMARK OFFICE

CERTIFICATE OF CORRECTION

PATENT NO. : 5,409,299

DATED : April 25, 1995

INVENTOR(S) : Tommie J. Holder

It is certified that error appears in the above-indentified patent and that said Letters Patent is hereby corrected as shown below:

On Title Page, Item [73] Assignee,"Rossevelt" should read --Roosevelt--.

Column 11, line 3, "means" should being a new paragraph.

Signed and Sealed this

Thirty-first Day of October 1995

*Attest:*

*Attesting Officer*

BRUCE LEHMAN

*Commissioner of Patents and Trademarks*